US006105583A

United States Patent [19]

Yamada

[11] Patent Number: 6,105,583

[45] Date of Patent: Aug. 22, 2000

[54] CIGARETTE END CONTAINER

[76] Inventor: Takanori Yamada, 1-6-1 Nozatoueno-cho, Himeji-shi Hyougo 670, Japan

[21] Appl. No.: 08/944,415

[22] Filed: Oct. 6, 1997

[51] Int. Cl.[7] ..... A24F 13/18; A24F 19/14; A24F 19/00; A24F 19/10

[52] U.S. Cl. ..... 131/235.1; 131/236; 131/231; 131/242; 131/256; 220/88.3; 169/56; 169/60; 239/70; 222/639

[58] Field of Search ..... 131/235.1, 256, 131/240.1, 242, 236, 231; 55/385.8; 220/88.3, 88.1; 169/26, 56, 60; 239/70; 222/638, 639

[56] References Cited

U.S. PATENT DOCUMENTS 2,690,755 10/1954 Haner ..... 131/237
3,542,039 11/1970 Blakeway ..... 131/242
5,012,961 5/1991 Madsen et al. ..... 222/643

*Primary Examiner*—James Derrington
*Assistant Examiner*—Dionne A. Walls
*Attorney, Agent, or Firm*—Oblon, Spivak, McClelland, Maier & Neustadt, P.C.

[57] ABSTRACT

A cigarette end container capable of putting out cigarette ends definitely, suitable for being placed in a narrow space without a reduction in container capacity, and in which disposal of cigarette ends after collection may be simply, easily and hygienically carried out. A body of a cigarette end container is provided with a device for relatively raising a concentration of incombustible gas and includes a gas cylinder filled with an incombustible gas, an injection nozzle having a jet inside the container, a passage for communicating the injection nozzle to the gas cylinder, an electromagnetic control valve disposed in the passage to control a flow rate of the incombustible gas, and a timer for presetting an opening time of the electromagnetic valve.

2 Claims, 1 Drawing Sheet

CIGARETTE END CONTAINER

BACKGROUND OF THE INVENTION

1. Field of the Invention

The present invention relates to a cigarette end container installed in public places such as a waiting room, station platform, etc. and, more particularly, to a cigarette end container suitable for containing cigarette ends automatically conveyed by means of a conveyor.

2. Prior Art

Generally, cigarette end containers are installed in public places for the convenience of cigarette smokers. In most of the conventional cigarette end containers, small bars, a grid, metal meshes or the like are mounted on an opening of the upper part so that cigarette ends are crushed out with the bars or grid and dropped inside, and when reaching a predetermined amount, the cigarette ends are taken out and collected to be finally disposed.

The mentioned type of cigarette end container is also employed for containing the cigarette ends conveyed automatically by means of a conveyor. For example, in game houses such as a pinball (pachinko) house or the like installed with a large number of pinball machines, every game machine is equipped with an ashtray considering a lot of pinball players having the habit of smoking. However, as the ashtray is obliged to be small and filled with cigarette ends in a rather short time, the cigarette ends are collectively conveyed outside by a conveyor to a separate cigarette end container, thus being collected and disposed automatically.

In the mentioned conventional cigarette end container, it is often the case that some of the cigarette ends are not completely crushed out or put out, and due to spread of smoke or fire inside the container, the entire cigarette end container comes to be filled with smoke while emitting an offensive odor around. Such an unpleasant situation should not be ignored not only from the viewpoint of a clean environment in a public place but also from the recent increasing trend of respecting the right to refuse tobacco smoke.

Moreover, in the mentioned automatic conveyance, collection and disposal of cigarette ends, if any cigarette end should not be put out definitely, it may be a problem in the aspect of prevention against disaster, and there is a possibility of inviting an accident. Therefore, in case of installing a cigarette end container particularly in any public place, it has been conventional to incorporate a water tank inside the cigarette end container so that any cigarette end may be put out by dropping it into the water tank. This conventional manner of putting out the cigarette ends is certainly effective in the early stage. However, because the cigarette ends float on the surface of the water without sinking, a problem exists in that cigarette ends dropped frequently one after another in the cigarette end container come to be accumulated on the floating cigarette ends, while percolation of water into the cigarette ends above the water is reduced, eventually resulting in a reduction in the putting out performance.

Further, because capacity of the cigarette end container is reduced as much as the water quantity in the water tank, it becomes necessary to employ a container of relatively large size. Therefore, another problem exists in that it is quite difficult to set or place such a relatively large size cigarette end container in a very narrow limited space where a large number of playing machines such as pinball (pachinko) machine are densely aligned.

Furthermore, when collecting cigarette ends in the water tank, because components such as nicotine, tar, etc. may dissolve and stick to the inside wall of the water tank, and cigarette ends themselves absorbing the water are dissolved into pieces, a further problem exists in that cleaning of the water tank is not always simple but rather troublesome. In particular, every water tank filled with cigarette ends must be replaced with a cleaned water tank very carefully, which gives not only a lot of stress to the cleaning worker but also something unpleasant to the players playing near the cigarette end container.

SUMMARY OF THE INVENTION

Accordingly, it is an object of the present invention to solve the above-discussed problems and has an object of providing a cigarette end container capable of putting out cigarette ends completely, suitable for being placed at a narrow space without reduction in container capacity, and in which disposal of cigarette ends after collection may be simply, easily and hygienically carried out.

To accomplish the foregoing object, there is provided according to the invention a cigarette end container for containing cigarette ends dropped in through an opening characterized by means for relatively raising a concentration of incombustible gas with respect to a concentration of oxygen inside the container.

In one specific aspect, the mentioned means for relatively raising the concentration of incombustible gas comprises a gas cylinder filled with an incombustible gas, an injection nozzle having a jet inside the container, a passage for communicating the injection nozzle to the gas cylinder, an electromagnetic control valve disposed in the passage to control flow rate of the incombustible gas, and a timer for presetting an opening time of the electromagnetic valve. The mentioned means further comprises a smoke sensor for detecting whether or not any smoke emitted from cigarette ends exists after opening the electromagnetic valve for a certain time by the timer, and spray means for spraying waterdrops to increase humidity inside the container when any smoke has been detected by the smoke sensor so that any cigarette end not yet completely put out may be definitely put out.

In the cigarette end container of above construction, since concentration of incombustible gas inside the container is kept at a high level by regular injection of an incombustible gas into the container body, even when any cigarette end not completely crushed out or put out is dropped into the container, the cigarette may be naturally put out by the incombustible gas with which the container is filled. Accordingly, there is no more problem, according to the invention, of reducing the capacity of containing cigarette ends due to a water tank occupying inside the conventional cigarette end container, and of increasing the capacity to meet it. Furthermore, as compared with the work of collecting the cigarette ends floating on the water, the crushed out cigarette ends may be easily collected in a dry state. There is no disadvantage of components such as nicotine, tar, etc. dissolving and sticking to the inside wall of the water tank, and the cigarette ends themselves dissolving into pieces due to absorption of water. After all, final disposal of the cigarette ends may be more simply and more hygienically carried out in the invention.

Other objects, features and advantages of the invention will become apparent in the course of the following description with reference to the accompanying drawings.

DESCRIPTION OF THE PREFERRED EMBODIMENT

Figure 1:
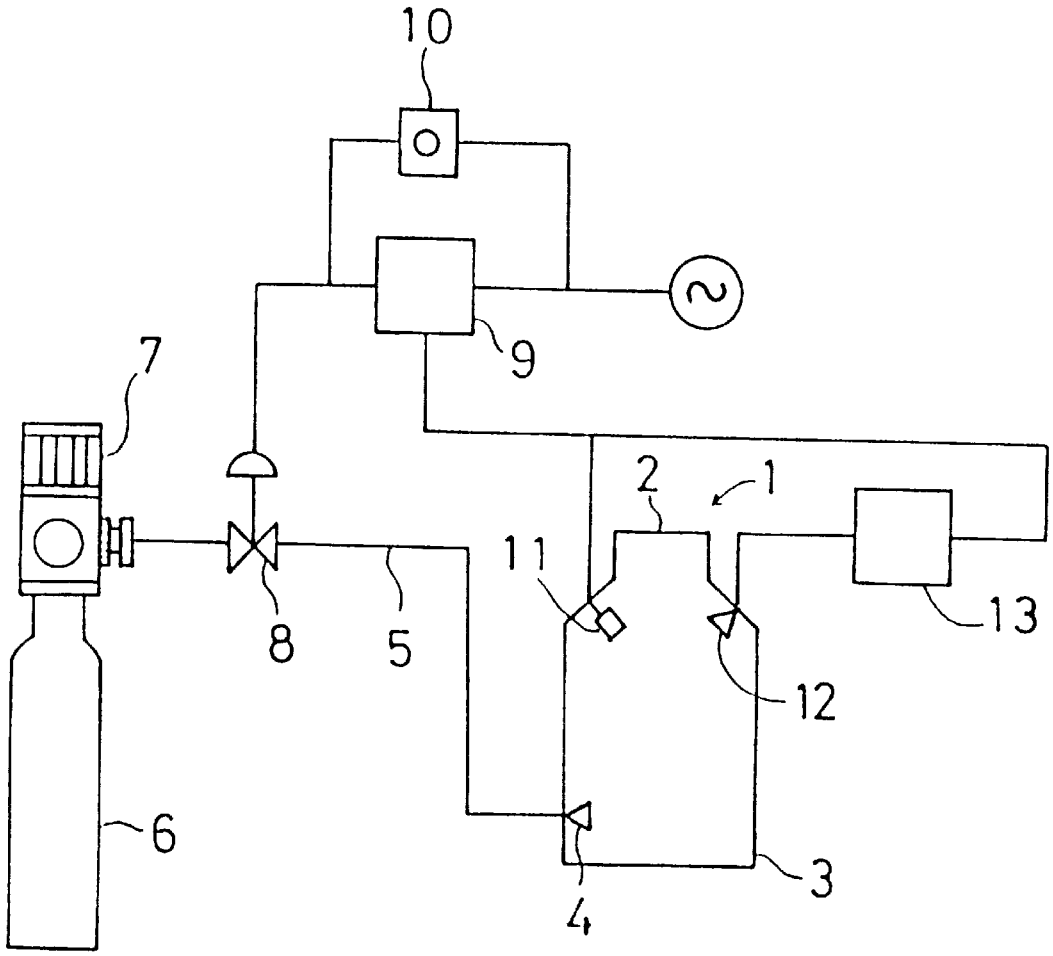
FIG. 1 is a schematic diagram showing an arrangement of the cigarette end container according to an embodiment of the invention.

An embodiment according to the invention is hereinafter described with reference to the drawing. Referring to FIG. 1 showing schematically one example of the invention, a cigarette end container 1 comprises an opening 2 through which cigarette ends are dropped in and a container body 3 made of a high air-tight material.

An injection nozzle 4 is disposed on the lower part of the container body 3 with a jet directed to inside the container. As shown in the drawing, the injection nozzle 4 is connected to a regulator 7 of a gas cylinder (cartridge) 6 through a passage 5. An incombustible gas such as carbon dioxide charged in the gas cylinder 6 is discharged to the injection nozzle 4 through the passage 5 by the regulator 7 so as to be injected into the container body 3.

Rate of injecting the incombustible gas into the container is controlled by an electromagnetic control valve 8 disposed on the passage 5. That is, the electromagnetic control valve 8 is regularly opened for a certain time and controls flow rate of carbon dioxide supplied into the container body 3 through the passage 5. The electromagnetic control valve 8 is driven by the operation of a timer 9 so that the valve 8 may be regularly opened every preset time.

More specifically, because the injection rate of carbon dioxide into the container may be set on the basis of how many times and when the electromagnetic control valve 8 is opened in a fixed time, considering capacity of the container body 3 and residence time of carbon dioxide corresponding to the capacity, opening frequency and opening time of the electromagnetic control 8 are calculated and set to the timer 9. Furthermore, carbon dioxide may be supplied into the container body 3, any time, by driving the electromagnetic control valve 8 by depressing a manual gas feed button 10 disposed together with the timer 9.

Further, a smoke sensor 11 for sensing cigarette smoke in the container in association with the operation of the timer 9 is disposed on the upper part of the container body 3. This smoke sensor 11 senses whether or not the container is filled with smoke of a cigarette end not put out yet, after passing a certain time from the opening of the electromagnetic control valve 8 by the operation of the timer 9 and the supply of carbon dioxide into the container body 3. The timer 9 is also set to control the operation time of the smoke sensor 11.

When the smoke sensor 11 senses any smoke of a cigarette end dropped in the container body 3 and not completely put out, a sensor signal is outputted from the smoke sensor 11 to a drive means 13 of a spray nozzle 12 disposed on the upper part of the container body 3. The spray nozzle 12 sprays waterdrops over the inside of the container body 3 by the drive means 13, whereby humidity inside the container body 3 is raised and the cigarette end still smoking is definitely put out.

In the cigarette end container 1 of the arrangement, as described above, since carbon dioxide which is an incombustible gas is regularly discharged from the injection nozzle 4 into the container body 3 thereby residence state of carbon dioxide being maintained, when dropping a cigarette end not yet completely put out into the container, the cigarette end may be naturally put out by the resident carbon dioxide. If there is any cigarette end still continuing to smoke, the smoke of the cigarette end is sensed by the smoke sensor 11 and waterdrops are sprayed by the spray nozzle 12, whereby the cigarette end may be definitely put out.

In this manner, even if any cigarette end not completely put out yet is dropped into the container, the cigarette end may be naturally put out and, therefore, there is no more problem of reducing the capacity of containing cigarette ends due to the water tank placed inside the conventional cigarette end container. Furthermore, as compared with the case of collecting the cigarette ends floating on the water, the crushed out cigarette ends may be collected in a dry state. Thus, there is no disadvantage of components such as nicotine, tar, etc. dissolving out and sticking to the inside wall of the water tank, and the cigarette ends themselves dissolving into pieces due to absorption of water. After all, since there is no more necessity to replace a water tank filled with cigarette ends, disposal of the cigarette ends may be more simply and more hygienically carried out by the cigarette end container according to the invention.

In the cigarette end container 1 of above arrangement, the gas cylinder 6 may be removably incorporated into the container body 3. The cigarette end container is suitable for being set separately in the public places such as a waiting room of a station, bank, etc. It is also preferable that the gas cylinder 6 is separately placed from the container body 3 by appropriately connecting the passage 5 to the container body 3. The electromagnetic control valve 8 may be operated both automatically and manually. Since the container body 3 may be placed without occupying a large space and disposal of cigarette ends may be easily performed, the cigarette end container according to the invention is quite suitable as a cigarette end container for automatic conveyance, collection and disposal of cigarette ends, for example, in a pinball (pachinko) house, etc.

Although carbon dioxide is employed as an incombustible gas in the foregoing embodiment, it is also preferable to use any other incombustible gas such as nitrogen which is easy to handle or advantageous from the viewpoint of cost, as the far as the concentration of incombustible gas is increased with respect to the concentration of oxygen in the container.

As many apparently widely different embodiments of this invention may be made without departing from the spirit and scope thereof, it is to be understood that the invention is not limited to the specific embodiments thereof except as defined in the appended claims.

What is claimed is:

1. A cigarette end container for containing cigarette ends dropped in through an opening, comprising:

means for relatively raising a concentration of incombustible gas with respect to a concentration of oxygen inside the container;

wherein said means further includes a smoke sensor for detecting whether or not any smoke emitted from cigarette ends exists after opening an electromagnetic valve for a certain time by a timer, and a spray means for spraying waterdrops to increase humidity inside the container when any smoke has been detected by the smoke sensor so that any cigarette end not yet completely put out may be definitely put out.

2. A cigarette end container comprising:

a container body having means for relatively raising a concentration of incombustible gas with respect to a concentration of oxygen inside the container;

a smoke sensor positioned inside the container body; and a nozzle, also positioned inside the container body, configured to spray waterdrops to extinguish a burning cigarette end when the nozzle is activated by the smoke sensor after detection of smoke in the container body.

* * * * *